United States Patent [19]

Yoshimura

[11] 4,244,619

[45] Jan. 13, 1981

[54] FOLDING CHAIR

[76] Inventor: Junzo Yoshimura, 8-6 Meziro 3-Chome, Toshima-Ku, Tokyo, Japan

[21] Appl. No.: 39,660

[22] Filed: May 16, 1979

[51] Int. Cl.[3] ..... A47C 4/08

[52] U.S. Cl. ..... 297/34; 297/36; 297/42

[58] Field of Search ..... 297/42, 44, 35, 36, 297/34, 440, 443; 108/124

[56] References Cited

U.S. PATENT DOCUMENTS

| | | | |
|---|---|---|---|
| 141,784 | 8/1873 | Geisler . | |
| 210,500 | 12/1878 | Clough | 297/443 |
| 233,257 | 10/1880 | Klett | 297/36 X |
| 489,369 | 1/1893 | Case | 108/124 |
| 780,008 | 1/1905 | Meffler . | |
| 1,017,342 | 2/1912 | Switzer . | |
| 1,091,634 | 3/1914 | Clouse . | |
| 1,146,358 | 7/1915 | Slatter et al. . | |
| 1,158,212 | 10/1915 | Henderson . | |
| 1,163,263 | 12/1915 | Rudduck | 297/36 |
| 1,283,564 | 11/1918 | Robinson | 297/36 |
| 1,686,599 | 10/1928 | Corser et al. | 297/34 |
| 2,089,818 | 8/1937 | Terker | 297/440 |
| 2,312,602 | 3/1943 | Taylor . | |

FOREIGN PATENT DOCUMENTS

| | | | |
|---|---|---|---|
| 826960 | 1/1952 | Fed. Rep. of Germany | 297/36 |

*Primary Examiner*—Francis K. Zugel

[57] ABSTRACT

The folding chair has uniquely hinged components so that it may be folded into a small, compact unit. Side supports are mounted so as to lie substantially parallel to the back support when folded, and to extend substantially perpendicularly from the back support when unfolded. The back of the chair is pivotally mounted on the back portion so that it rests against the outer surface of the back support when the chain is folded and it rests at a slight angle to the vertical plane between the side supports when the chair is unfolded. Pivotally mounted on the back of the chair is a seat which rests substantially parallel to the back when the chair is folded and rests in a substantially horizontal plane between the side supports when the chair is unfolded.

12 Claims, 10 Drawing Figures

FOLDING CHAIR

FIELD OF THE INVENTION

In recent years chairs which are sufficiently small to be stored in a relatively small area have become increasingly popular. This is because more and more people are moving to smaller quarters. Consequently, there is less room in their home for couches, sofas and chairs. Therefore, it frequently becomes a problem that during parties or when friends drop in there is an insufficient number of seats for all those present. The best solution to this problem is to have folding chairs which can be stored in a closet when not in use.

The main disadvantage of the presently known folding chairs is that they are, as a rule, quite uncomfortable. Most, if not all, folding chairs do not have armrests. Even worse is the fact that these chairs rarely are provided with cushions for the seat or back of the chair. Because of this guests are frequently subjected to the torment of sitting on a very hard and uncomfortable chair.

Therefore, it is a prime objective of applicant to provide a folding chair which is both compact and comfortable. Because of a unique design of the hinges and elements of the chair, applicant is able to obtain a chair which folds into a very compact package. Moreover, the particular structure of this chair permits the use of a cushion on the seat to make the chair even more comfortable for the user.

DESCRIPTION OF THE PRIOR ART

Switzer (U.S. Pat. No. 1,017,342) discloses a convertible article of furniture. The item in question is capable of serving both as a chair and as a table. Further, if folded in a certain manner, the device can even serve as a screen for a fireplace or as a room corner. Inasmuch as Switzer never intended for this article to be stored for any period of time, he did not consider the compactness of the article as a whole. Thus, the article is somewhat bulky. In fact, there is no disclosure at all of how to fold the device into a compact unit so that it may be stored. Because of the number of panels and sections of the article, it is not possible to fold the sections together. Thus, this device does not disclose a comfortable folding chair which can be folded into a compact unit for storage in a relatively small area.

Geisler (U.S. Pat. No. 141,784) discloses a very simple type of folding chair. One of the problems with this type of construction is that it is not sufficiently sturdy or rigid to support an extra heavy person. Moreover, its design is such that it is not very comfortable for those who sit on it. No side armrests are disclosed or taught. In addition, though the chair designed by Geisler folds into a relatively small package, this package is rather bulky and is difficult to carry.

Robinson (U.S. Pat. No. 1,283,564) discloses a nursery chair which is very much more complicated than the folding chair envisioned by applicant. This nursery chair includes a toilet seat and a tray which swing into position. The main seat is secured by hinges to the front of the auxiliary seat, and not to any portion of the back. When not in use, the seat rests in a vertical position against the lower portion of the forward legs. Since the various components of the Robinson nursery chair are different than those used by applicant, its construction is obviously different. More importantly, the manner by which the components are folded together to form a compact unit is quite different in each case. Furthermore, since applicants are concerned only with providing a comfortable folding chair they do not provide all the extra components used by Robinson. Thus, applicant's chair folds into a much more compact unit. In addition, Robinson's device does not disclose how to alter the angle of the back of the chair in order to provide a more comfortable seat. Also, no disclosure is made of how to provide cushions or other soft means on or in place of the main seat 18 or the back portion. Thus, this particular nursery chair is very uncomfortable and, because it is a nursery chair, not usable by adults. In addition, it does not fold into a compact unit which can be transported easily from place to place.

Clouse (U.S. Pat. No. 1,091,634) discloses a very simplistic type of foldable chair. This chair includes a number of pivoted strips which hold or brace the chair together, but which slide in slots, so as to permit the folding of the chair. This chair does not provide a suitable armrest or comfortable seat and back portions. Further, the chair does not fold into a relatively compact package and is instead rather bulky when folded. Thus, it is extremely difficult to carry and to transport from place to place. Storage is also a problem with this foldable chair as it takes up a fairly large amount of space.

Still another very elementary type of folding chair is disclosed by Mettler (U.S. Pat. No. 780,008). This chair includes crisscross pieces serving as each of the leg portions. Cross pieces are used to provide the spacing between the legs. The back portion and the seat are hinged together. As can be seen from the drawings, one of the pieces of each of the legs is pivoted on the back of the chair. Thus, when the back is folded downward, the various pieces making up the legs pivot and cause the chair to be folded into a relatively compact package. However, this chair is very uncomfortable because of its design and provides no armrests for the user. Further, its construction is such that an exceptionally heavy person could not sit in this chair.

An analysis of the prior art shows that there is a need for a folding chair which is comfortable, extremely strong, foldable into a very compact package and aesthetically pleasing. Though some of the prior art devices may be relatively strong, they do not fold into compact packages and are not comfortable. Likewise, some of the prior art devices which are comfortable or relatively compact when folded are simply not all that strong. Thus, a unique folding chair has been constructed which is strong, compact when folded and, most of all, comfortable.

DETAILED DESCRIPTION OF THE INVENTION

Figure 1:
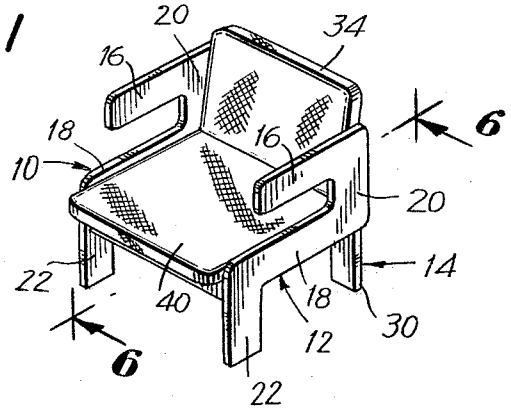
FIG. 1 is a perspective view of the chair in its unfolded or working state.
Figure 5:
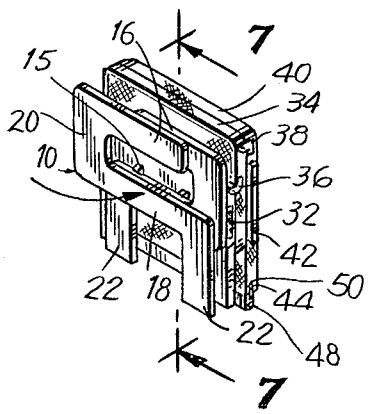
Figure 4:
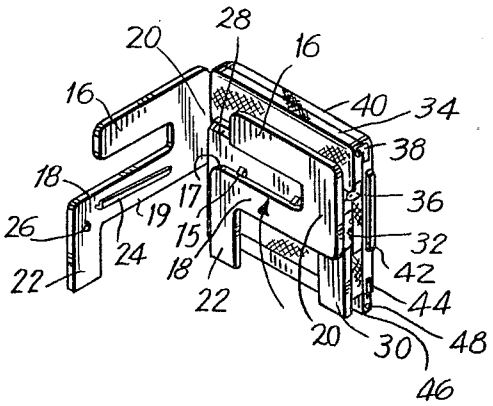
Figure 3:
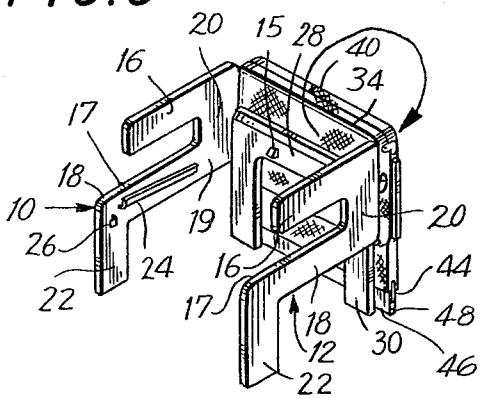

Referring now to FIGS. 1–7, the folding chair is shown in its various positions, FIG. 1 showing its completely unfolded position and FIG. 5 showing its completely folded position. In the preferred embodiment, the structual components of the chair are made of a wood material. However, it is quite possible to make the chair of this invention from any other suitable material, so long as the material selected is strong enough to support the weight of a reasonable size person. As for the seat and back of the chair, cushions are preferably used as these members of the chair. It is also possible to provide a less comfortable chair, which does not have cushions and in which a relatively flat board is used as the seat or back of the chair. Such a flat board can be made from wood, as are the support members of the chair, or it may be made from any other suitable material.

There are three basic structural components of the chair, namely two side supports 10 and 12 and a back support 14. Each of the side supports 10 and 12 is similarly made. An upper horizontal portion 16 and a lower horizontal portion 18 are provided on each of the side supports 10 and 12. In most applications, the horizontal portion 16 can be used as the armrest of the chair. Generally, the lower horizontal portion 18 will serve to support the seat of the chair. As shown in the various figures, there is a spacing between these two portions. However, it is possible to make them as a single solid portion. A connecting portion 20 secures the two horizontal portions 16 and 18 together. Extending downward from the horizontal portion 18 is a leg 22, which serves as one of the front legs of the chair. In the preferred embodiment of the chair, the upper and lower horizontal portions 16 and 18, the connecting portion 20 and the leg 22 are made as a single unitary piece. However, it must be recognized that in certain embodiments it may be desirable to manufacture the side supports with separate pieces, instead of making it a single unitary piece.

Extending longitudinally across the inside surface 19 of the horizontal portion 18 is a guide 24. This guide is preferably an elongated L-shaped member. Any suitable means may be used for attaching the guide to the horizontal portion 18. One of the possible ways is to provide a downwardly extending portion of the guide which may be screwed into the surface of the horizontal portion 18. Adhesives, such as glue, may also be used to attach the guide to the horizontal portion.

Attached to the inside surface 23 of the leg 22 is a holding member 26. As with the guide 24, the holding member 26 may be attached in any suitable manner to the leg 22.

The back support 14 can be made in any suitable shape. Preferably, it has a solid upper portion 28 and a pair of legs 30 extending downward from the upper portion 28. With some chairs, it will be possible to make the entire back support 14 as a single relatively rectangular unit. In such a case, the entire support would serve as a single rear leg of the chair.

Figure 7:
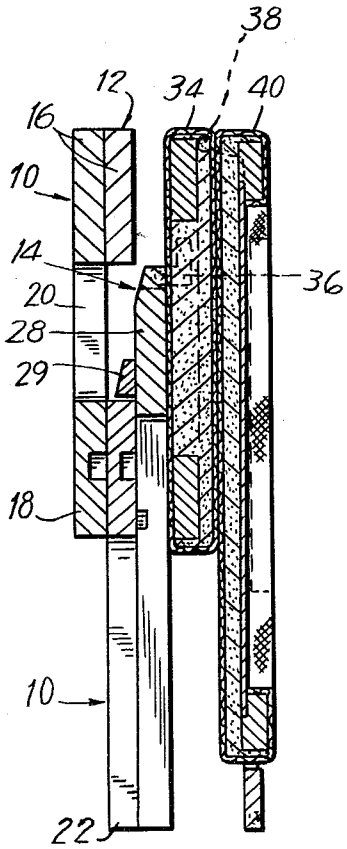
FIG. 7 is a cross-sectional view, taken along the lines 7—7 of FIG. 5, showing a particular portion of a completely folded chair.

Conventional hinges 32 are used to pivotally connect the side supports 10 and 12 and the back support 14. One of the plate portions of each of the hinges 32 is secured in any suitable manner to the back support 14. The other plate portion of each of the hinges is secured in any suitable manner to a respective side support. Each of the hinges should be designed so that one of the side supports (the left side support 12) can fold against the back support 14 and the other side support (the right side support 10) can fold on top of the other side support. As can be seen in FIG. 7, when folded, the side supports 10 and 12 and the back support 14 should be flush with each other and should be disposed in substantially parallel planes. If desired, the chair can be designed so that there is some spacing between each of the pieces. In some embodiments, it may be desirable to provide the back support 14 with stubs 15. Thus, the upper surface 17 of the lower horizontal portion 18 can snap under the stubs 15 to securely hold the pieces in a folded position.

A relatively rectangular and flat member is used as the back 34 of the chair. Preferably, a cushioned member is used, but any suitable material or member may be used. In some applications, it may be desirable to provide a stiffening member inside the cushion, such as a wood block. Right angle brackets 36 are used to pivotally mount the back 34 on the back support 14. One of the portions of the bracket 36 is pivotally mounted, as by a pin or bolt, at an upper portion of the side of the back support 14. The other side of the bracket is secured by a plurality of bolts, or like members, in the back 34 of the chair. In some cases, it may be desirable to provide an essentially rectangular bracket, instead of the right angle bracket. So long as the bracket securely holds the back 34, any shaped bracket and any number of bolts or fasteners may be used.

The portion of the bracket mounted on the back 34 should be sufficiently displaced from the end of the back so that the back 34 may rotate about the top of the back support 14. After rotating about the top of the back support 14, the extreme end of the back 34 should come to rest on a support stud 29 projecting outward from somewhere on the upper portion 28 of the back support 14. Because of the way the bracket 36 is constructed, the back 34 will be inclined with respect to the vertical plane. Thus, it will provide a more comfortable back portion for the user of the chair. It is also possible to construct the chair so that the back is essentially straight up and down. By appropriately designing the support stud 29 and the bracket 36 and displacing the bracket a sufficient distance from the end of the back 34, almost any angle for the back can be obtained. If desired, the stud can extend across the entire surface of the upper portion 28 or just a portion thereof.

Connected to the back 34 by another bracket 38 is the seat 40 of the chair. The bracket 38 is similar to the bracket 36 described above and is arranged so as to pivot about a pin, or similar means, positioned on the end of the back 34. As is true of the bracket 36, the bracket 38 can be made in some other shape than that of a right angle bracket.

Longitudinally attached to the side portions of the seat 40 are guide rails 42 which are designed to interact with the guides 24 situated on the inside surfaces of the side supports 10 and 12.

Extending from the front of the seat 40 are two elongated brackets 44 which are designed to pivot about the front end of the seat 40. Attached to the distal ends of the brackets 44 is a front support 46. Pins, bolts or other suitable means are used to attach the front support 46 to the bracket 44 so that the front support 46 may rotate about the pins or bolts.

The specific construction of the seat 40 is dependent on the type of chair desired. In the preferred embodiment the seat is made out of a soft cushion which is comfortable for persons sitting for a long period of time on the chair. It is also possible to use a plain wooden board as the seat if a less expensive chair is desired. Furthermore, any material that is strong enough to support a person's weight can be used as the seat. Also, the specific construction of the seat can be varied according to the specific aesthetic quality of the chair that is desired.

In its folded condition, the chair is extremely compact and easy to store (FIG. 7). To prepare the chair for assembly, one need only carry it from its storage location to the area where it is intended to be used.

Figure 2:
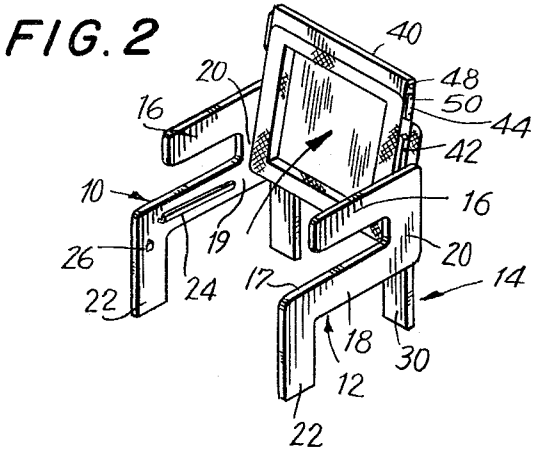
FIGS. 2–5 are perspective views showing the chair in its various folding positions.
Figure 6:
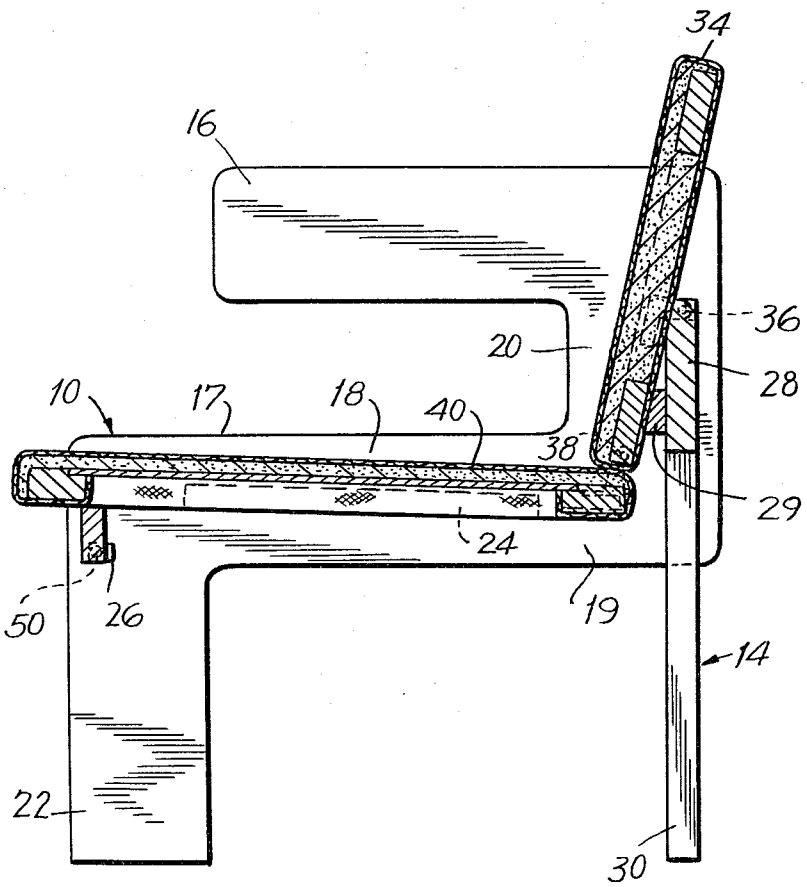
FIG. 6 is a cross-sectional view, taken along the lines 6—6 in FIG. 1, showing a particular portion of an unfolded chair.

The first step in unfolding the chair it to rotate outwardly the right side support 10 until it is substantially at a right angle with the back support 14 (FIG. 6). Then, the left side support 12 is rotated outward about its hinge unitl it is substantially parallel to the right side support 10 and substantially perpendicular to the back support 14 (FIG. 5). Now, the back 34 is rotated or pivoted with the bracket 36 over the top of the back support 15 (FIG. 2). When this step is completed, the lower portion of the back 34 will be resting on the stud 29 situated somewhere on the upper portion 28 of the back support 14 and will be angled to a certain extent with respect to the vertical plane.

Then, the bracket 44 is rotated about the bottom of the seat 40 until it extends substantially perpendicular to the seat 40. The front support 46 is then rotated until it is disposed between the guide rails 42. To retain the front support in this position a pair of lugs or stubs 48 are aligned with and disposed in respective apertures 50 in the brackets 44. Finally, the seat 40 is pivoted about the bottom or lower end of the back 34 until the seat is in a substantially horizontal position (FIG. 1). In this position, the guide rails 42 fit into the guides 24. In such a manner, the side supports 10 and 12 rigidly hold the seat in position. In addition, the stubs 48 of the front support 46 fit into the holding members 26 on the legs 22 of the side supports.

Such a construction of the folding chair is extremely strong and will not accidentally come apart. To fold the chair the above steps are merely reversed.

Figure 10:
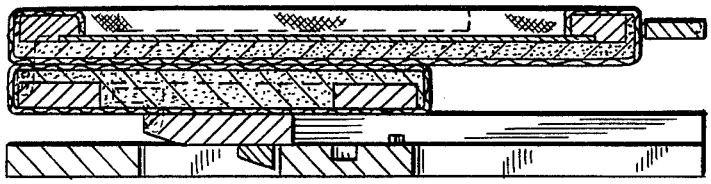
FIG. 10 is a cross-sectional view, taken along the lines 10—10 of FIG. 9, of a particular portion of the completely folded sofa.
Figure 9:
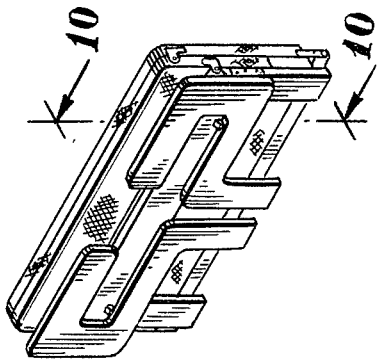
FIG. 9 is a perspective view of the folding sofa shown in FIG. 8 in its completely folded state.
Figure 8:
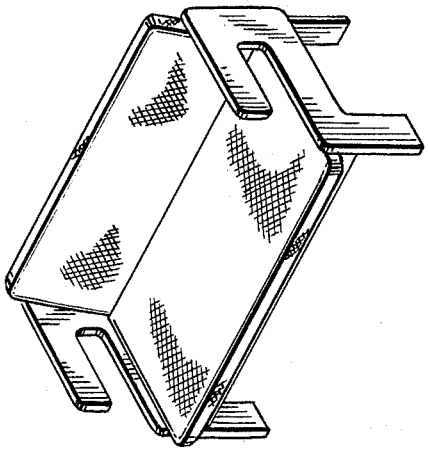
FIG. 8 is a perspective view of a folding sofa made in accordance with the principles of this invention.

FIGS. 8–10 show another embodiment of the invention. In this embodiment instead of making a folding chair, a folding sofa is made according to the principles of this invention. The operation and construction of the sofa are identical to that of the chair with one minor exception. In this case because of the overall length of the sofa, it is not possible for the side supports to fold over each other as in the case of the chair. Instead, they independently fold against the back support. In all other regards, this sofa is constructed as is the chair.

Using the same principles of construction and design it is possible to make many other types of furniture. The only limitation is the imagination of the furniture designer.

I claim:

1. A folding chair comprising:

a back support;

two side supports movably mounted on said back support, such that said back support and said side supports lie in substantially parallel planes when said chair is folded, and said side supports extend substantially perpendicularly from said back support when said chair is unfolded;

a back portion movably mounted on said back support, such that said back portion rests substantially parallel and adjacent a rear portion of said back support when said chair is folded, and said back portion rests against a front portion of said back support between said side supports when said chair is unfolded; and a seat movably mounted on said back portion, such that said seat rests substantially parallel to said back portion when said chair is folded, and said seat rests in a substantially horizontal plane between said side supports when said chair is unfolded.

2. A folding chair according to claim 1, wherein said back portion is mounted such that said back portion is in a substantially vertical plane when said chair is unfolded.

3. A folding chair according to claim 1, wherein said back portion is mounted such that said back portion is at an angle to a vertical plane when said chair is unfolded.

4. A folding chair according to claim 3, wherein said back support is provided with a support means against which a lower portion of the back portion rests when said chair is unfolded.

5. A folding chair according to claim 1, wherein said back support is provided with means for engaging a top surface of one of said side supports when said chair is folded.

6. A folding chair according to claim 1, wherein said seat comprises a cushion.

7. A folding chair according to claim 1, wherein said back portion comprises a cushion.

8. A folding chair according to claim 7, wherein said seat comprises a cushion.

9. A folding chair according to either of claims 1, 3, 6, 7 or 8, wherein a guide is provided on an inner surface of one of said side supports; and a guide rail is provided on an outer side surface of said seat, such that said guide rail is received in said guide when said chair is unfolded.

10. A folding chair according to claim 9, wherein holding members are provided on said inner surfaces of said side supports; and wherein front support is pivotally mounted on a front end of said seat, such that said front support extends substantially perpendicularly from said seat and is held in place by said holding members when said chair is unfolded.

11. A folding chair according to claim 1, wherein said side supports lie in substantially the same parallel plane when said chair is folded.

12. A folding chair according to claim 1, wherein said side supports lie in separate substantially parallel planes when said chair is folded.

* * * * *